US009185967B2

(12) United States Patent
Geiberger

(10) Patent No.: US 9,185,967 B2
(45) Date of Patent: Nov. 17, 2015

(54) TOOTHBRUSH

(75) Inventor: Christoph Geiberger, Koenigswinter (DE)

(73) Assignee: GlaxoSmithKline Consumer Healthcare GmbH & Co, Buehl (Baden) (DE)

( * ) Notice: Subject to any disclaimer, the term of this patent is extended or adjusted under 35 U.S.C. 154(b) by 1631 days.

(21) Appl. No.: 11/916,775

(22) PCT Filed: Jun. 7, 2006

(86) PCT No.: PCT/EP2006/005606

§ 371 (c)(1),
(2), (4) Date: Jun. 20, 2008

(87) PCT Pub. No.: WO2006/131397

PCT Pub. Date: Dec. 14, 2006

(65) Prior Publication Data

US 2009/0038097 A1 Feb. 12, 2009

(30) Foreign Application Priority Data

Jun. 9, 2005 (GB) ..... 0511778.3

(51) Int. Cl.

| | |
|---|---|
| ***A46B 9/04*** | (2006.01) |
| ***A46B 5/00*** | (2006.01) |
| ***A46B 3/20*** | (2006.01) |
| ***A46B 7/06*** | (2006.01) |

(52) U.S. Cl.

CPC ..... *A46B 5/0029* (2013.01); *A46B 3/20* (2013.01); *A46B 7/06* (2013.01)

(58) Field of Classification Search

CPC ..... A46B 3/20; A46B 7/06; A46B 5/0029
USPC ..... 15/167.1, 183, 176.4, 176.6, 201, 187, 15/188, 207.2, 110
See application file for complete search history.

(56) References Cited

U.S. PATENT DOCUMENTS

| | | | | | |
|---|---|---|---|---|---|
| 2,053,905 | A | * | 9/1936 | Fuller | 15/167.1 |
| 2,154,352 | A | * | 4/1939 | Peterson | 15/167.1 |
| 2,685,703 | A | * | 8/1954 | Dellenbach | 15/167.1 |
| 4,330,896 | A | * | 5/1982 | Booth | 15/172 |
| 4,333,199 | A | * | 6/1982 | Del Rosario | 15/167.1 |
| 4,488,328 | A | * | 12/1984 | Hyman | 15/167.1 |
| 4,566,145 | A | * | 1/1986 | Wachtel | 15/201 |
| 4,694,844 | A | * | 9/1987 | Berl et al. | 15/167.1 |
| 4,776,054 | A | * | 10/1988 | Rauch | 15/167.1 |
| 5,052,071 | A | | 10/1991 | Halm | |
| 5,054,154 | A | | 10/1991 | Schiffer et al. | |
| 5,360,026 | A | * | 11/1994 | Klinkhammer | 132/308 |

(Continued)

FOREIGN PATENT DOCUMENTS

| | | |
|---|---|---|
| EP | A0336641 | 10/1989 |
| EP | 0923326 B1 | 6/2003 |

(Continued)

*Primary Examiner* — Joseph J Hail
*Assistant Examiner* — Joel Crandall
(74) *Attorney, Agent, or Firm* — Joshua C. Sanders; Theodore R. Furman

(57) ABSTRACT

A toothbrush head in which oral hygiene parts, in particular toothbrush bristles, are set in a flexible pad. Typically the pad is made of a thermoplastic elastomer or a polyurethane gel material. The pad is supported on support parts which are connected to the toothbrush handle in various ways, for example arms or a web structure.

6 Claims, 15 Drawing Sheets

(56) References Cited

U.S. PATENT DOCUMENTS

Figure 1:
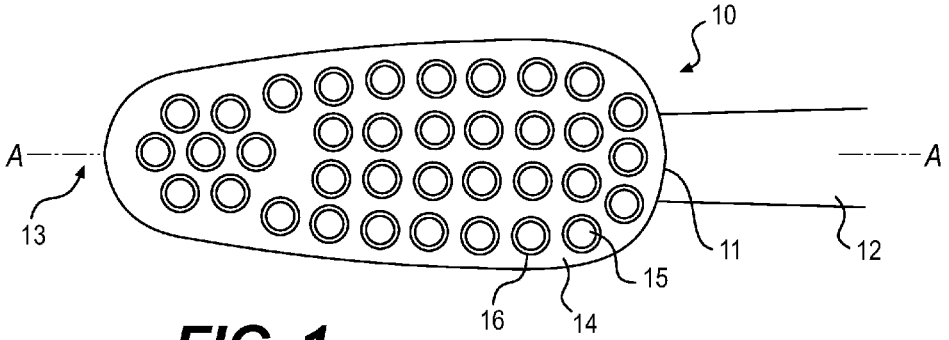

| | | | | |
|---|---|---|---|---|
| 5,398,366 | A * | 3/1995 | Bradley | 15/167.1 |
| 5,435,032 | A * | 7/1995 | McDougall | 15/22.1 |
| 5,651,158 | A * | 7/1997 | Halm | 15/167.1 |
| 5,774,923 | A * | 7/1998 | Halm | 15/167.1 |
| 5,802,656 | A * | 9/1998 | Dawson et al. | 15/110 |
| 5,946,759 | A * | 9/1999 | Cann | 15/167.1 |
| 6,088,870 | A * | 7/2000 | Hohlbein | 15/167.1 |
| 6,988,777 | B2 * | 1/2006 | Pfenniger et al. | 300/5 |
| 7,020,928 | B2 * | 4/2006 | Hohlbein | 15/167.1 |
| 7,418,759 | B2 * | 9/2008 | Huber et al. | 15/167.1 |
| 7,921,499 | B2 * | 4/2011 | Huber et al. | 15/167.1 |
| 2004/0158948 | A1 * | 8/2004 | Sander et al. | 15/188 |
| 2005/0138743 | A1 * | 6/2005 | Huber et al. | 15/167.1 |
| 2006/0080795 | A1 * | 4/2006 | Pfenniger et al. | 15/167.1 |
| 2007/0271717 | A1 * | 11/2007 | Clos et al. | 15/167.1 |
| 2007/0277339 | A1 * | 12/2007 | Barsheshet | 15/167.1 |

FOREIGN PATENT DOCUMENTS

| | | | |
|---|---|---|---|
| WO | WO97/20484 | A | 6/1997 |
| WO | WO00/47083 | A | 8/2000 |
| WO | WO00/60980 | | 10/2000 |
| WO | WO03/001943 | A | 1/2003 |
| WO | WO2006/005216 | A | 1/2006 |

* cited by examiner

TOOTHBRUSH

This application is a §371 national phase entry of International Application No. PCT/EP2006/005606, filed Jun. 7, 2006.

This invention relates to toothbrushes, in particular to toothbrush heads.

Toothbrushes are well-known articles and normally comprise a head and a grip handle, generally with a neck region between the head and handle, all arranged along a longitudinal head-handle direction.

Normally toothbrushes are made primarily of a rigid plastic material, e.g. a polypropylene or styrol acryl nitrol ("SAN"). Many are so called two-component toothbrushes comprising a part made of such a plastic, e.g. the head and the main structure of the handle and any intermediate neck made integrally, termed herein a "skeleton", and a part made of a softer resilient elastomer, such as a thermoplastic elastomer e.g. Santoprene™ which may comprise part of the grip handle to enhance grip, or may be part of a flexible feature. Such toothbrushes are disclosed for example in U.S. Pat. No. 5,054,154 and EP-A-0 336 641 among others. Toothbrush heads generally incorporate oral hygiene parts such as bristles, which project from the head in a bristle direction.

Two component toothbrushes are normally made by a process in which the hard plastic material part of their structure, the "skeleton" is first made, generally by injection moulding. Then this plastic part is enclosed in a mould cavity which defines the shape of the elastomer material part, and the elastomer material of the second component in a fluid state is injected into this mould cavity to form the elastomer material part. Normally the plastic material skeleton is formed with one or more cavity to receive this second material.

A known toothbrush has a head in which bristle tufts are fixed into a pad of an elastic material such as a thermoplastic elastomer supported by a plastic material support. To provide a strong connection between the bristle tufts and the elastic material EP 0 923 326 B1 discloses use of small cup-shaped holders embedded in the elastic material to retain the bristle tufts.

The advantage of such a pad of elastic material is that the pad is flexible in numerous directions, allowing the bristle tufts fixed therein to adapt themselves to the three dimensional contours of the teeth, and so that excessive tooth brushing pressures can be relieved. There remains the possibility of further improvement of such toothbrushes incorporating an elastic pad, particularly to the supporting of the pad to modify and improve its flexibility characteristics.

A first embodiment of the invention provides a toothbrush head having a first end connected or connectable to a toothbrush handle, and an opposite second end distant from the handle when connected thereto, the head comprising an elastic material pad in which are fixed oral hygiene parts, such as bristles, and comprising a plastic material support for the pad, characterized in that the support comprises three or more support parts which support the pad at three or more respective separated support places.

The direction between the first and second ends is herein termed the longitudinal direction.

In this first embodiment, by "separated support places" is meant that within the pad itself there is no plastic material connecting part between the support parts, so that within the pad the support parts are connected only by the elastic material of the pad between them.

The support functions to connect the pad to the toothbrush handle. Suitably the support is resiliently flexible, i.e. capable of resilient flexible bending under the influence of pressures experienced as the toothbrush head is used to brush the teeth.

For example there may be three, four, five, six, seven or eight, or more support parts. The support parts may be arranged at the apexes of a polygon, regular or irregular, but preferably symmetrically bisected by a longitudinal axis. If such a polygon contains an odd number of apexes, preferably an apex points away from the handle. For example there may be three support parts arranged in a polygon being a triangle, preferably isosceles or equilateral, with its base perpendicular to the longitudinal direction, and its apex pointing away from the handle.

The support parts may be connected together in various ways.

For example support parts, at the apexes of a polygon, may be connected together by one or more link along one or more side of the polygon.

For example the support may comprise a plastics material spine extending parallel to the longitudinal direction, e.g. under the pad, linking the support parts, and example plural support parts may branch from the spine in a direction transverse to this direction and connect the spine to the support parts.

For example plural support parts may radiate from a central link part.

A second embodiment of the invention provides a toothbrush head having a first end connected or connectable to a toothbrush handle, and an opposite second end distant from the handle when connected thereto, the head comprising an elastic material pad in which are fixed oral hygiene parts, such as bristles, and comprising a plastic material support for the pad, characterized in that the support comprises two plastics material arms extending generally longitudinally on opposite sides of the pad with a connection between the arms and the pad.

The connection between the arms and the pad is preferably a flexible connection.

The arms in the second embodiment may be resiliently flexible and may be resiliently flexibly connected to the handle. For example there may be a resiliently flexible neck part extending integrally between the first end and the handle.

In another form of this embodiment such arms may be connected at a connection point furthest from the handle, and this connection point may be connected integrally to the handle by means of a longitudinal spine extending underneath the pad.

In another form of this embodiment such arms may be provided by a neck part between the grip handle and the head, terminating at its end closest to the head in a "Y" shape, with the two divergent limbs of the "Y" being the arms, and the stem of the "Y" comprising the neck part.

A third embodiment of the invention provides a toothbrush head having a first end connected or connectable to a toothbrush handle, and an opposite second end distant from the handle when connected thereto, the head comprising an elastic pad in which are fixed oral hygiene parts, such as bristles, and comprising a plastic material support for the pad, characterized in that the support is connected to the grip handle of the toothbrush by plural spines extending generally longitudinally respectively between the first end of the head and the handle.

Preferably the spines are resiliently flexible.

In this third embodiment there are preferably two spines on respective opposite sides of the longitudinal axis of the toothbrush. The support may for example comprise three or more support parts which support the pad at three or more respective separated support places as in the first embodiment.

In this third embodiment there are preferably two spines on respective opposite sides of the longitudinal axis of the toothbrush. The support may for example comprise plural support parts which support the pad at plural respective separated support places as in the first embodiment.

In this third embodiment the support may comprise two plastics material arms extending generally longitudinally on opposite sides of the pad with a flexible connection between the arms and the pad. Each of such two arms may comprise an integral extension of two respective spines.

In these second and third embodiments there may be a gap between the arms and the pad, or the pad and the arms may be in sliding contact.

In one form of the second and third embodiments such arms may extend along all or part of widthways opposite sides of the pad.

In the above embodiments the pad may be flexibly connected to the arms by being attached to the arms at the perimeter of the pad, the elastic nature of the pad providing an inherent flexible connection. For example a part of the arms adjacent to the pad may be shaped to conform to the outer surface of the pad, and/or may be adapted to be embedded in the pad. For example the pad may have a thickness transverse to the longitudinal direction, and the pad may be linked to the arms by one or more linking portion of the pad of a reduced thickness. For example the pad may be linked to the arms only at certain discrete link places around the perimeter of the pad, with places around the perimeter of the pad between these link places being unconnected to the arms, for example being spaced from the arms or being in sliding contact with the arms. For example such arms may be connected to the pad by a link, which may terminate in a support part.

Another way in which the pad may be flexibly connected to the arms is for plural oral hygiene parts to be fixed in the pad and for these oral hygiene parts to be connected to the arms. For example such oral hygiene parts may be held in small holders, and the holders connected to the arms. For example plural such holders may be connected together by a web structure, e.g. as described below, which may be integral with the holders. Alternatively oral hygiene parts may be held in holders which are connected to each other only by the material of the pad, i.e. holders are "islands" in the elastic pad material.

A support part may comprise a plastic material part attached to the pad. Such a support part may be attached to an outer surface of the pad. For example the support part may comprise a plastic material part shaped to conform to, the outer surface of the pad.

A support part may comprise a plastic material part which is embedded in the pad.

For example a support part may comprise a rounded e.g. circular or oval, disc, or ring of any shape, which can be embedded in the pad to provide a large contact surface.

Such a support part may be linked to an above-mentioned spine, central link part or frame by a respective link arm, which may be flexible, between the support part and the spine, central link part, frame or arm.

A fourth embodiment of the invention provides a toothbrush head having a first end connected or connectable to a toothbrush handle, and an opposite second end distant from the handle when connected thereto, the head comprising an elastic pad in which are fixed oral hygiene parts such as bristles, and having a thickness parallel to the direction in which the oral hygiene parts extend, and comprising a plastic material support for the pad, characterized in that the plastic material support comprises a frame completely surrounding the pad, the pad being connected to the frame by means of one or more perimeter region of the pad being of a reduced thickness relative to a part of the pad more distant from the perimeter.

The pad is preferably flexibly connected to the frame.

In this fourth embodiment the pad may be flexibly connected to the frame by means of plural oral hygiene parts being connected to the frame. For example such oral hygiene parts may be held in small holders, and the holders connected to the frame. For example plural such holders may be connected together by a web structure as described herein, which may be integral with the holders. Alternatively oral hygiene parts may be held in holders which are connected to each other only by the material of the pad, i.e. holders are "islands" in the elastic pad material.

A fifth embodiment of the invention provides a toothbrush head having a first end connected or connectable to a toothbrush handle, and an opposite second end distant from the handle when connected thereto, the head comprising an elastic pad in which are fixed oral hygiene parts such as bristles, and having a thickness parallel to the direction in which the oral hygiene parts extend, and comprising a plastic material support for the pad, characterized in that the plastic material support comprises a frame completely surrounding the pad, the pad being connected to the frame by means of oral hygiene parts being connected to each other by a web structure which is connected to the frame.

The pad is preferably flexibly connected to the frame

There may be a gap between the frame and the pad, or the pad and the frame are in sliding contact.

In this fifth embodiment the pad may also be flexibly connected to the frame e.g. by means of one or more perimeter region of the pad being of a reduced thickness relative to a part of the pad more distant from the perimeter.

A sixth embodiment of the invention provides a toothbrush head having a first end connected or connectable to a toothbrush handle, and an opposite second end distant from the handle when connected thereto, the head comprising an elastic pad in which are fixed oral hygiene parts, such as bristles, and comprising a plastic material support for the pad, characterized in that the plastic material support comprises an arm extending generally longitudinally underneath the pad to a support part intermediate between longitudinally opposite ends of the pad, and being connected to the pad at this support point, the perimeter of the pad being otherwise unsupported.

In this sixth embodiment the arm may be connected to the pad at a support point approximately half way between longitudinally opposite ends of the pad. The arm in this embodiment may be connected to the pad by means of a support part.

The elastic pad may for example be made of a thermoplastic elastomer material of a known type which bonds well to the types of plastic material used for toothbrush construction such as polypropylene or acrylonitrile butadiene styrene (ABS). Construction of such materials facilitates the manufacture of the toothbrush using known two-component injection moulding techniques. Alternatively the pad may be made of a polyurethane gel material. Typically the pad may be 3-5 mm thick, and of a shape and size comparable with conventional toothbrush heads. Oral hygiene parts may project from a surface of the pad (for convenience called the upper surface). The axis between the first and second ends is termed for convenience the length direction of the pad.

Although bristles are the most common type of oral hygiene part, alternative parts such as elastic fingers or strips e.g. to massage gums or to wipe deposits off the teeth may also be used, e.g. in combination with bristles.

A web structure may for example comprise cup-shaped or ring-shaped holders of the type mentioned above, made of a plastic material and linked together by web-forming integral links of the plastic material. In this web- structure each holder may be linked to two or more adjacent holders, and the web structure may also include one or more holder linked by a link to only one other holder. A web structure may be linked to a frame by one or more such link, e.g. crossing a gap between the pad and frame. One or more holders may be linked to a frame by such a link. Two or more web structures may be independent e.g. to provided groups of tufts with different responses to brushing pressures applied thereto.

The invention also provides a toothbrush comprising a head of one of the embodiments disclosed herein connected to a toothbrush grip handle, optionally with a neck region between.

The toothbrush head and toothbrush of this invention may be made by a generally known two-component injection moulding process in which first the plastics material parts of the toothbrush are made in a first injection mould, and then these plastic material parts are enclosed in a second injection mould and the elastic material of the pad is injected into the second injection mould. By selecting the injection conditions of the elastic material in a known manner the elastic material can be caused to bind securely to the plastic material.

Figure 52:
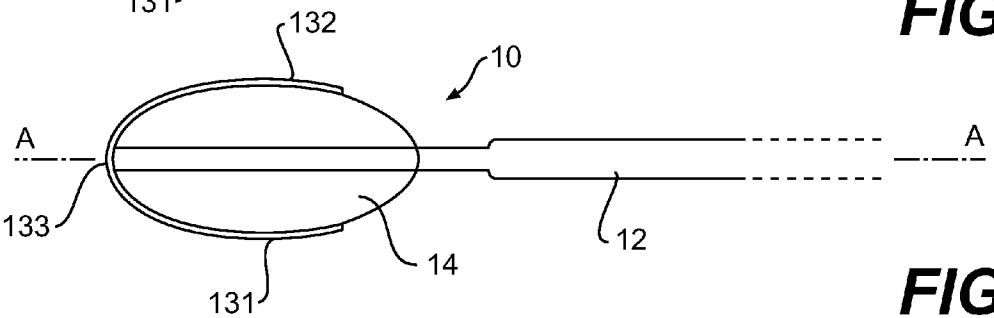

The invention will now be described by way of example only with reference the accompanying drawings which show:

FIGS. 1 to 52 show various plan, side and underside views of a toothbrush of the first embodiment of this invention.

Figure 2:
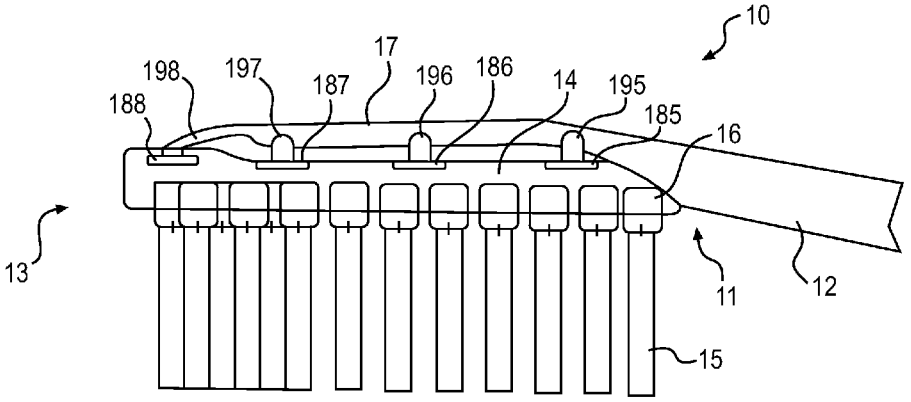
Figure 3:
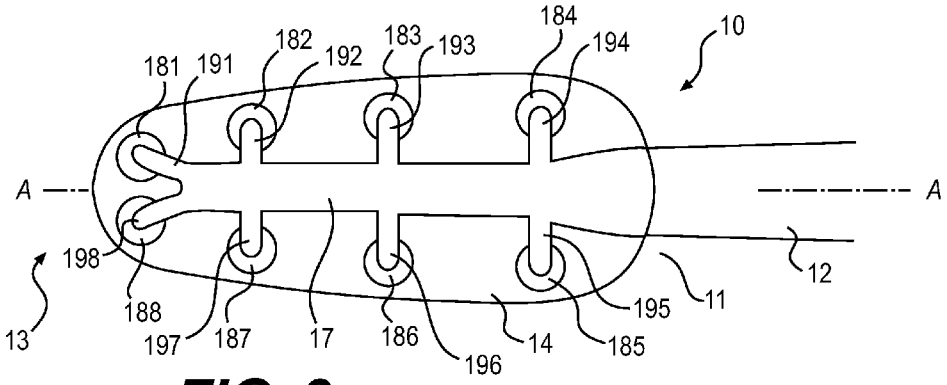

Referring to FIGS. 1, 2 and 3, a toothbrush head 10 of the this invention is shown in a plan view FIG. 1, a side view FIG. 2 and an underside view FIG. 3. The head has a first end 11 integrally made with and thereby connected to a toothbrush handle 12, and an opposite second end 13 distant from the handle 11 connected to the head 10. The direction A-A between the first and second ends 11-13 is herein termed the longitudinal direction. The handle 12 is generally conventional.

The head 10 comprises an elastic, i.e. thermoplastic elastomer, pad 14 in which are fixed oral hygiene parts being bristles 15. The plural bristles are fixed into the pad by means of small cup-shaped plastics material holders 16 set in the pad.

The pad 14 is supported by a support part 17 which comprises eight support parts 181-188 which support the pad at eight respective separated support places. Within the pad 14 itself there is no plastic material connecting part between the support parts 181-188 so that within the pad 14 the support parts 181-188 are connected only by the elastic material of the pad 14 between them.

The support 17 functions to connect the pad 14 to the toothbrush handle 12 so that the pad 14 may be moved in use by the user to bring the bristles 15 into contact with the teeth. The support 17 is resiliently flexible, i.e. capable of resilient flexible bending under the influence of pressures experienced as the toothbrush head 10 is used to brush the teeth. The eight support parts 181-188 are arranged at the apexes of an irregular octagon, symmetrically bisected by a longitudinal axis.

The support 17 comprises a plastics material spine 17 extending parallel to the longitudinal direction A-A, e.g. under the pad 14 (the surface of the pad 14 from which bristles 15 extend being termed for convenience the upper surface), linking the support parts 181-188. The support parts 181-188 are each linked to spine 17 by a respective flexible link arm 191-198 between the support parts 181-188 and the spine 17 such that the arms 191-198 branch from the spine 17 in a direction transverse to the longitudinal direction to connect the spine 17 to the support parts 181-188. Each support part 181-188 comprises a circular disc at the end of an arm 191-198 embedded in the pad 14.

Figure 4:
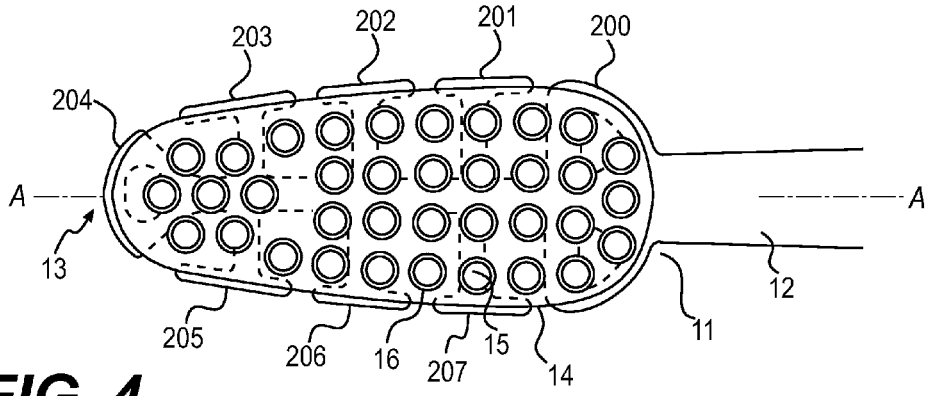
Figure 5:
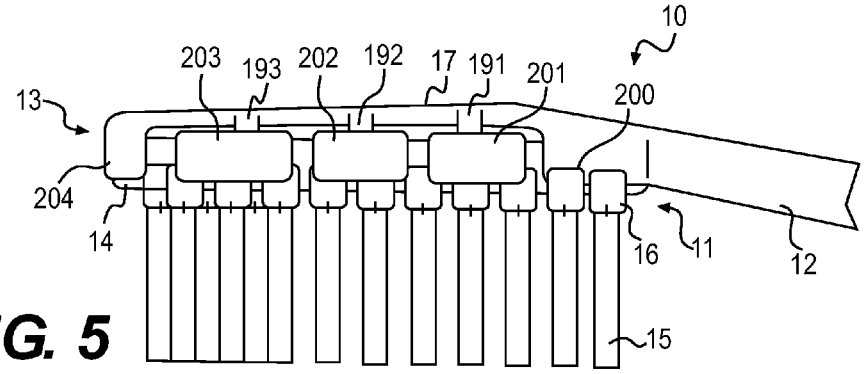
Figure 6:
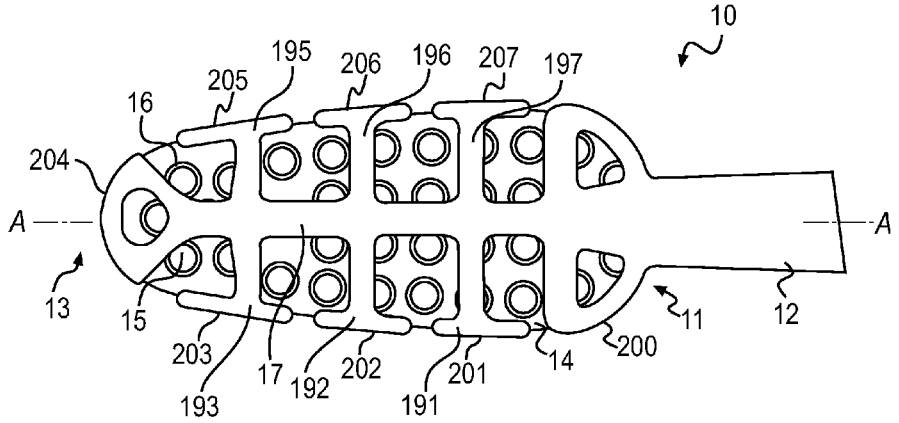
Figure 7:
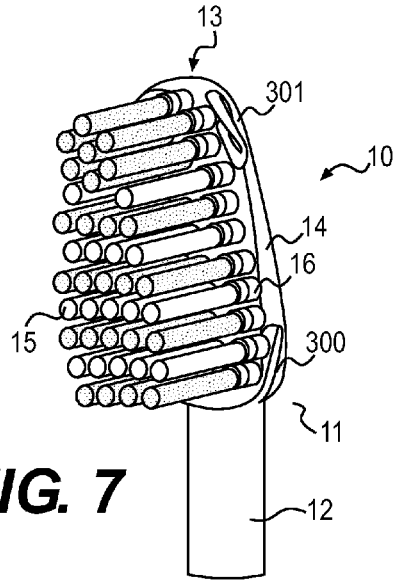
Figure 8:
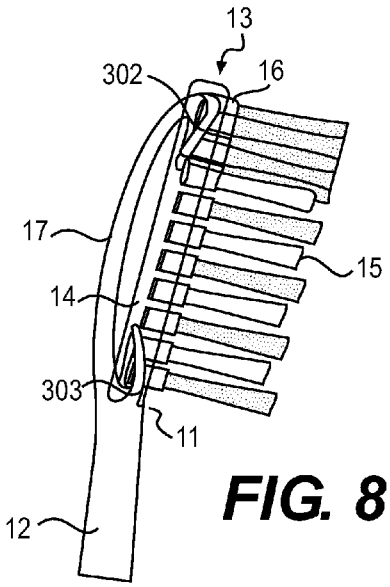
Figure 9:
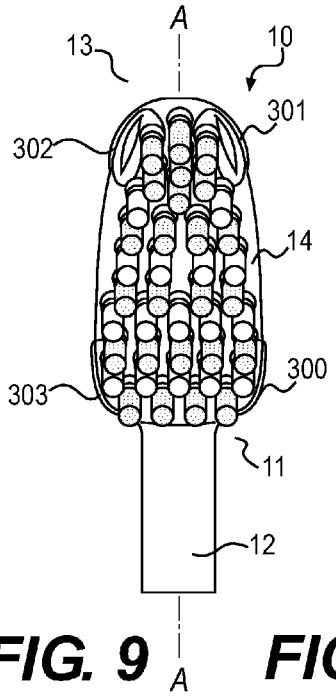
Figure 10:
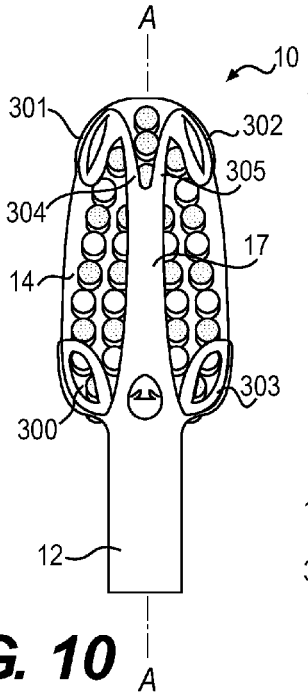
Figure 11:
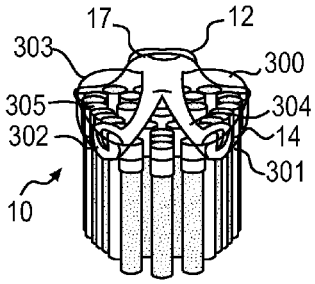
Figure 12:
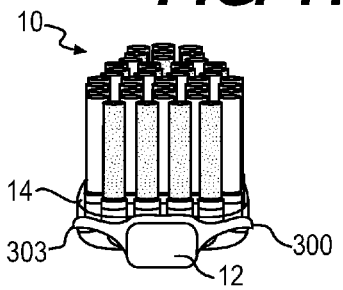
Figure 13:
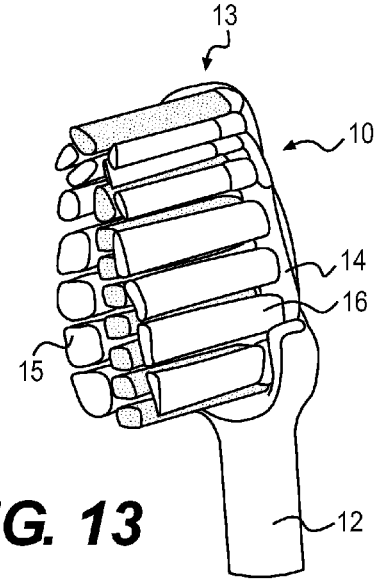
Figure 14:
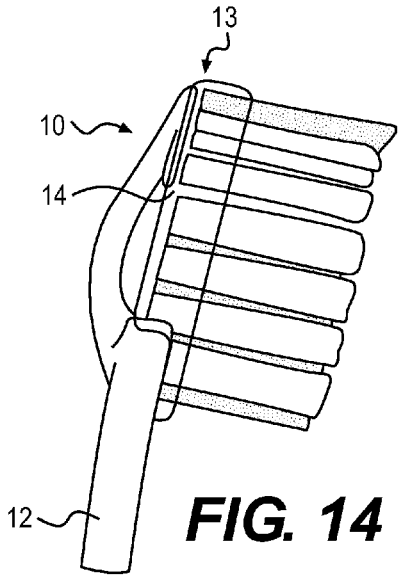
Figure 15:
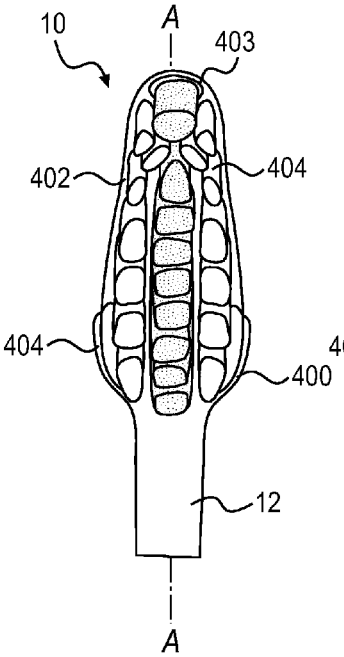
Figure 16:
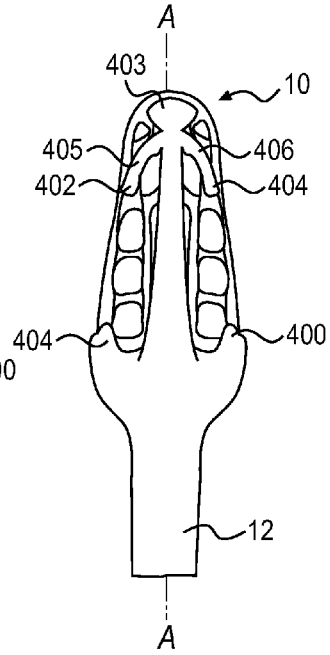
Figure 17:
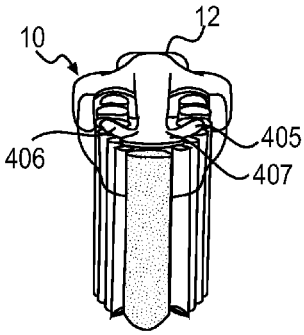
Figure 18:
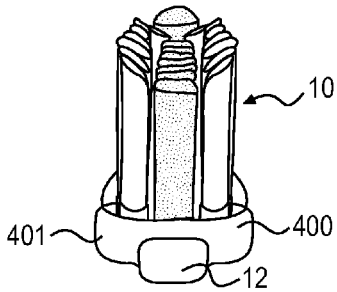

FIGS. 4, 5 and 6 show a toothbrush head of similar construction to that of FIGS. 1-3 and corresponding parts are numbered correspondingly. Here there are also eight separate support parts 200-207 linked to the spine 17 by arms 191-198. In FIGS. 4-6 the support parts 200-207 each comprise a plastic material part shaped to conform to the outer surface of the pad 14.

FIGS. 7-12 show various views of a toothbrush of similar construction to FIGS. 1-6 and corresponding parts are numbered correspondingly. Here there are also four separate support parts 300-303, two of which 300,303 are linked directly to the spine 17, and two of which 301,302 are linked to the spine 17 by arms 304,305. In FIGS. 8-12 the support parts 300-303 each comprise an or oval ring embedded in the pad 14.

FIGS. 13-18 show various views of a toothbrush of similar construction to FIGS. 1-12 and corresponding parts are numbered correspondingly. Here there are also five separate support parts 400-404, two of which 402,404 are linked to the spine 17 by arms 405,406. In FIGS. 8-12 the support parts 400-404 each comprise a plastic material part embedded in the pad 14.

Figure 19:
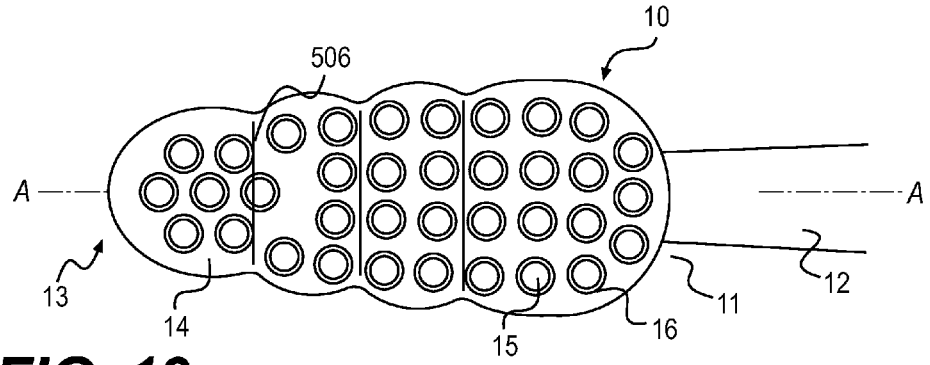
Figure 20:
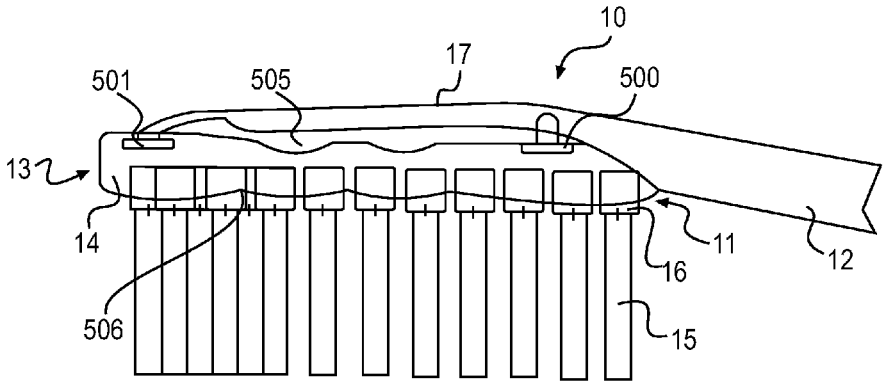
Figure 21:
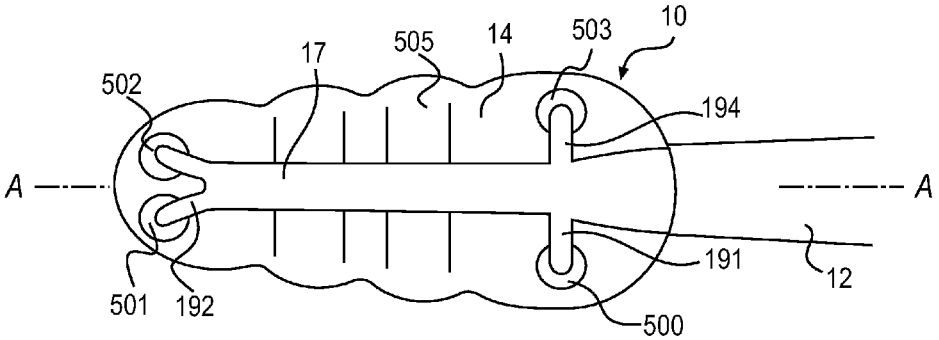
Figure 22:
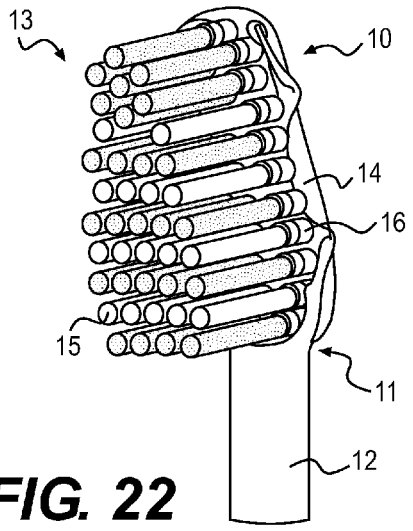
Figure 23:
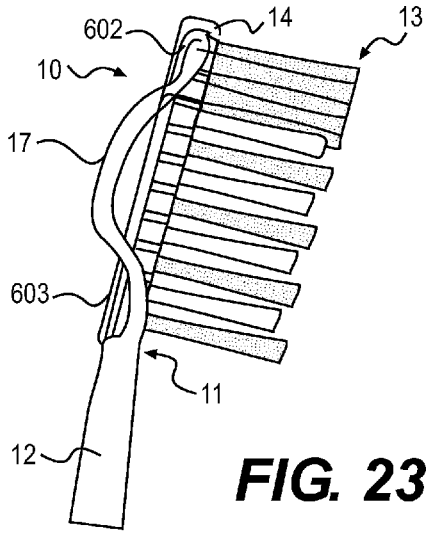
Figure 24:
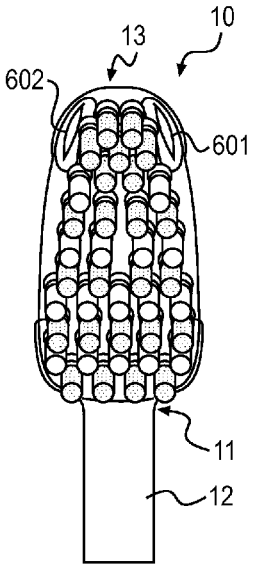
Figure 25:
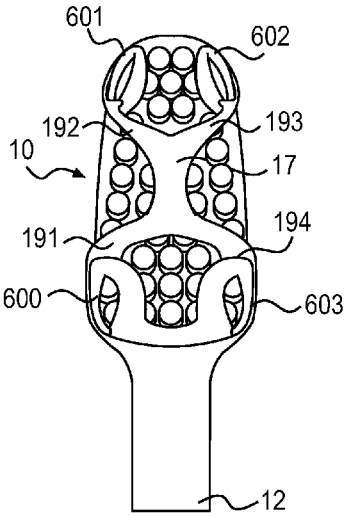
Figure 26:
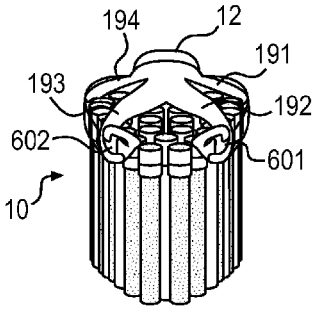
Figure 27:
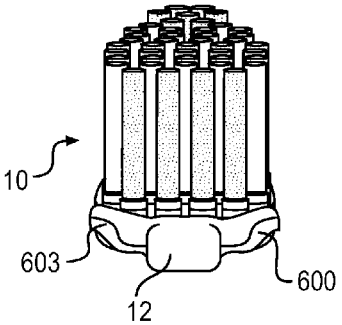

FIGS. 19, 20 and 21 show various views of a toothbrush of similar construction to FIGS. 1-18 and corresponding parts are numbered correspondingly. Here there are four separate support parts 500-503, each linked by arms 191-194 to the spine 17 in a construction similar to FIGS. 1-3. However the pad 14 in FIGS. 19,20,21 has plural widthways extending grooves 505 in its lower surface and 506 in its upper surface to concentrate the flexibility of the pad 14 at these grooves.

FIGS. 22-27 show various views of a toothbrush of similar construction to FIGS. 1-21 and corresponding parts are numbered correspondingly. Here there are four separate support parts 600-603, each linked by arms 191-194 to the centrally located spine 17, so that the arms radiate from the spine 17. In FIGS. 22-27 the support parts 600-603 each comprise an oval ring-shaped plastic material part shaped to conform to the outer surface of the pad 14.

Figure 28:
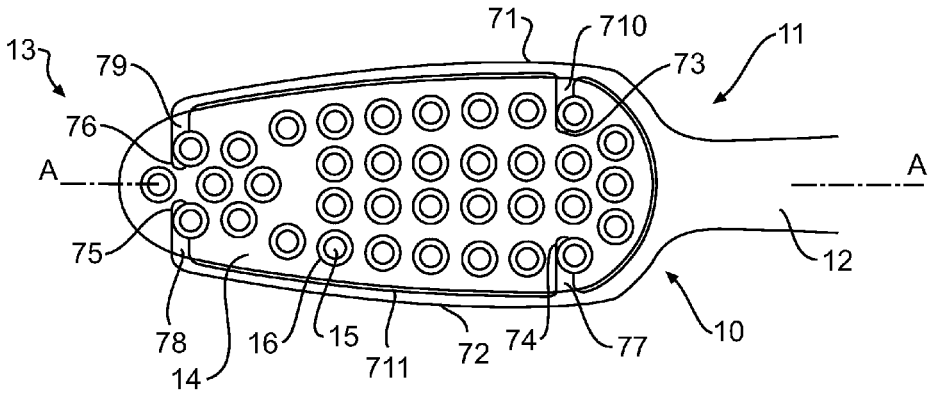
Figure 29:
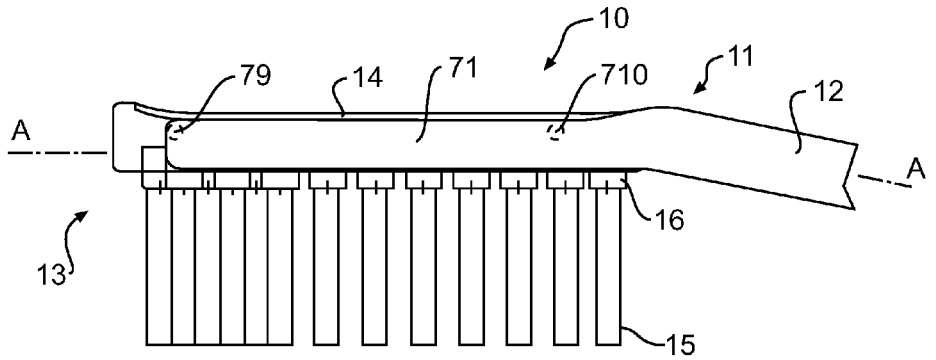

FIGS. 28 and 29 show respective plan and side views of a toothbrush head 10 of the invention, parts corresponding to FIGS. 1-27 being numbered correspondingly. The support in this embodiment comprises two plastics material arms 71,72 extending generally longitudinally on opposite sides of the longitudinal direction, which extend along part of widthways opposite sides of the pad 14 but are not connected to each other adjacent the end of the pad 14 remote from handle 12. Four support parts 73,74,75,76 comprise the extremities of link arms 77,78,78,710 connected to the arms 71,71. There is a gap 711 between the arms 71,72 and the pad 14.

Figure 30:
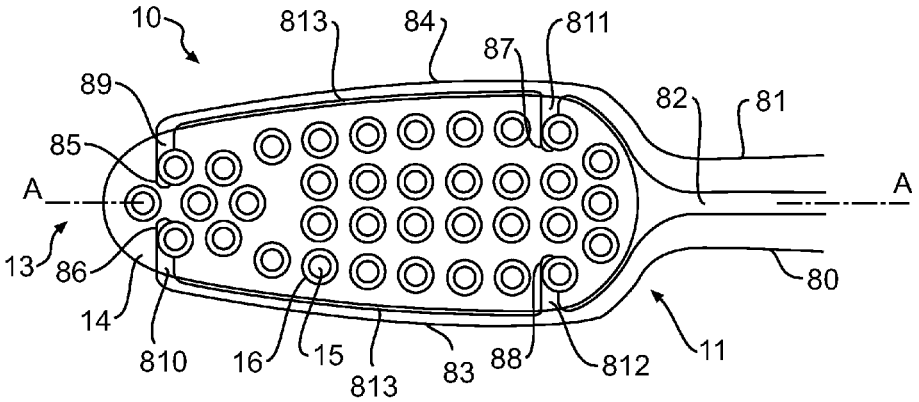
Figure 31:
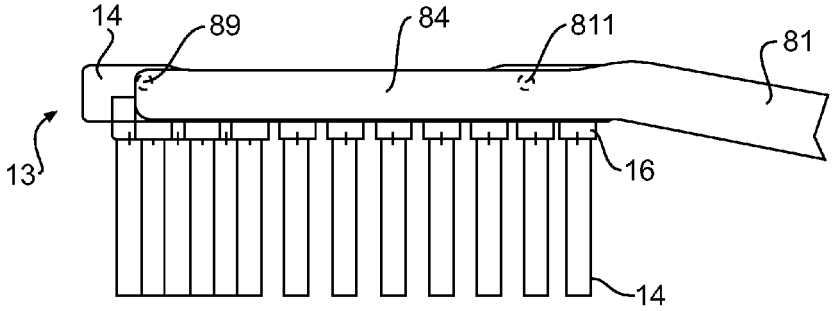
Figure 32:
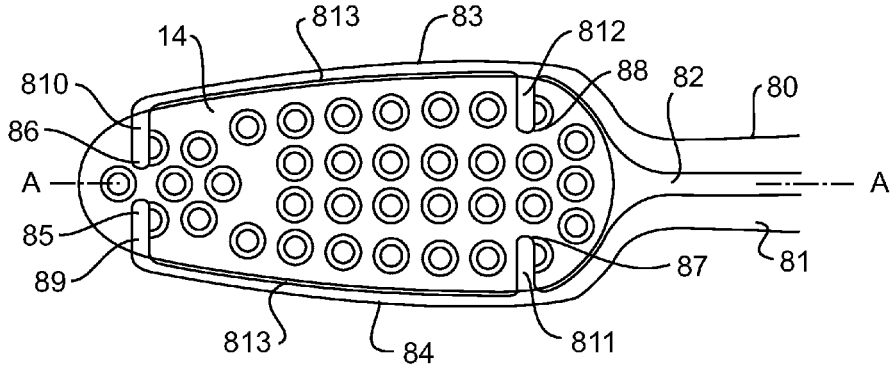

FIGS. 30, 31 and 32 show respective plan and side views of a toothbrush head 10 of another embodiment of this invention, parts corresponding to FIGS. 1-29 being numbered correspondingly. The support is connected to the grip handle 12 (not shown in FIGS. 30-32) of the toothbrush by two resiliently flexible spines 80,81 extending generally longitudinally respectively between the first end 11 of the head 10 and the handle 12 (not shown), with a gap 82 between them. The two spines 81,82 are on respective opposite sides of the longitudinal axis A-A of the toothbrush. The support comprises two plastics material arms 83,84 extending generally longitudinally along part of widthways opposite sides of the pad on opposite sides of the longitudinal direction A-A, connected to four support parts 85,86,87,88 being the extremities of corresponding links 89,810,811,812. There is a gap 813 between the arms 83,84 and pad 14. Each of such two arms 83,84 comprises an integral extension of the two respective spines 80,81.

Figure 33:
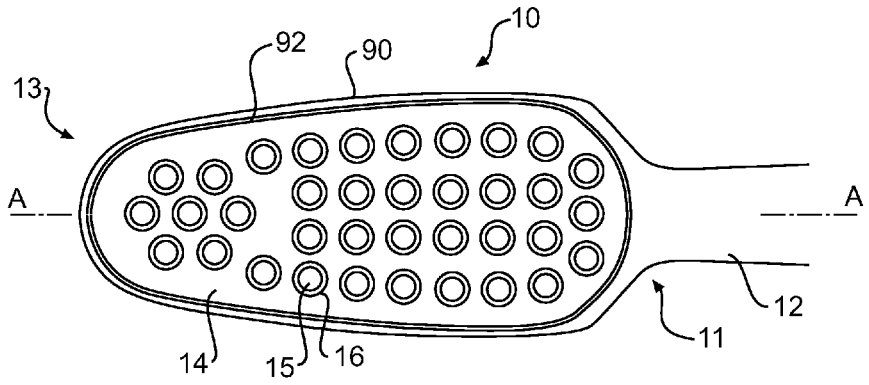
Figure 34:
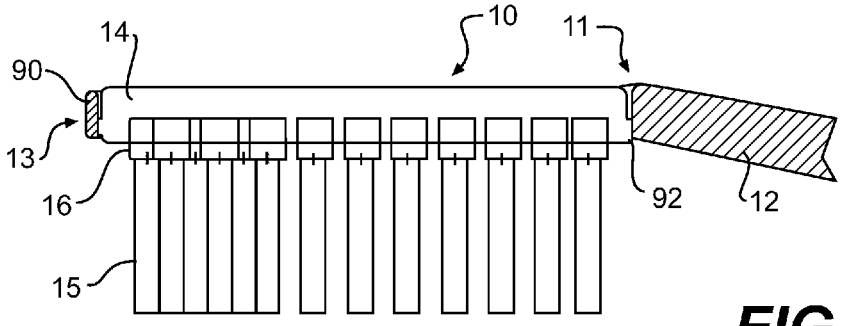
Figure 35:
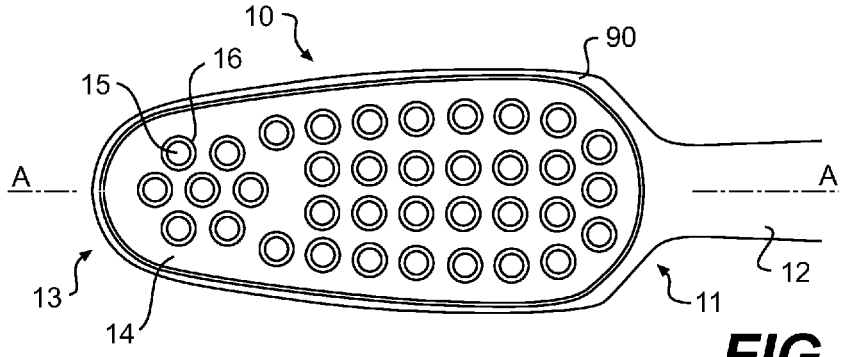
Figure 36:
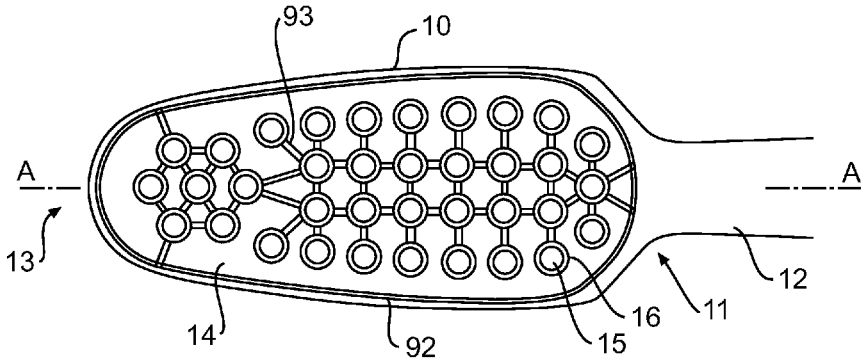
Figure 37:
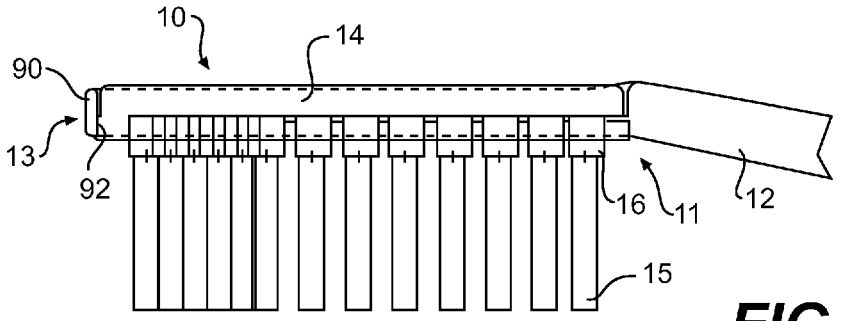
Figure 38:
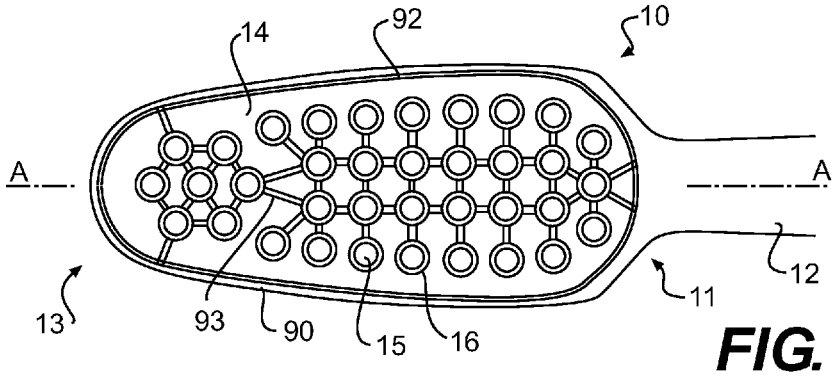

FIGS. 33, 34 and 35 also show respective plan, side and underside views of a toothbrush head 10 of another embodiment of this invention, parts corresponding to FIGS. 1-32 being numbered correspondingly. The plastic material support 90 comprises a frame completely surrounding the pad 14, which is flexibly connected to the frame 90. Plural tufts of bristles 15 are fixed into the pad 14 held in holders 16 which are connected to each other only by the material of the pad, i.e. holders 16 are "islands" in the elastic pad 14 material. The pad 14 is flexibly connected to the frame 90 by being attached to the frame 90 at the perimeter of the pad 14. The pad 14 is linked to the frame 90 by a continuous perimeter linking portion 92 of the pad 14 being of a reduced thickness.

Figure 39:
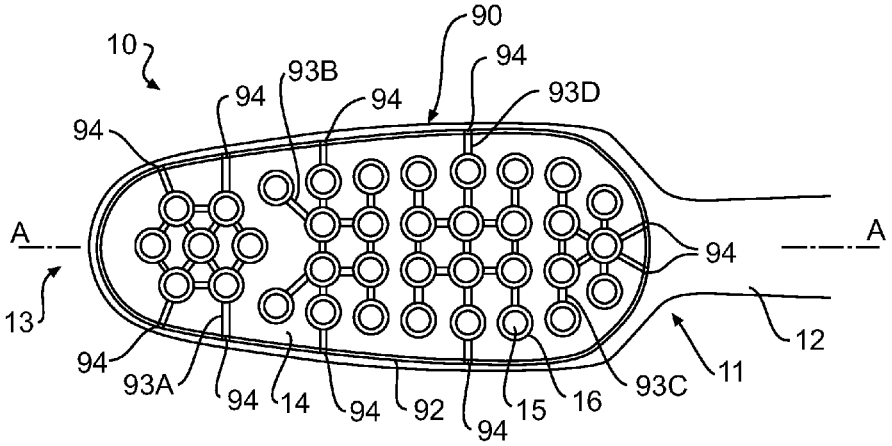
Figure 40:
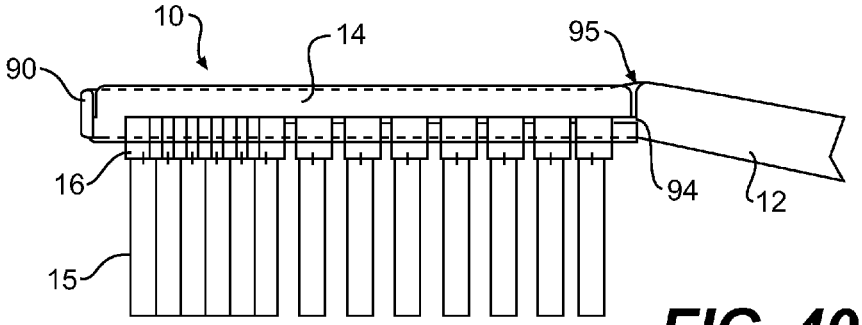
Figure 41:
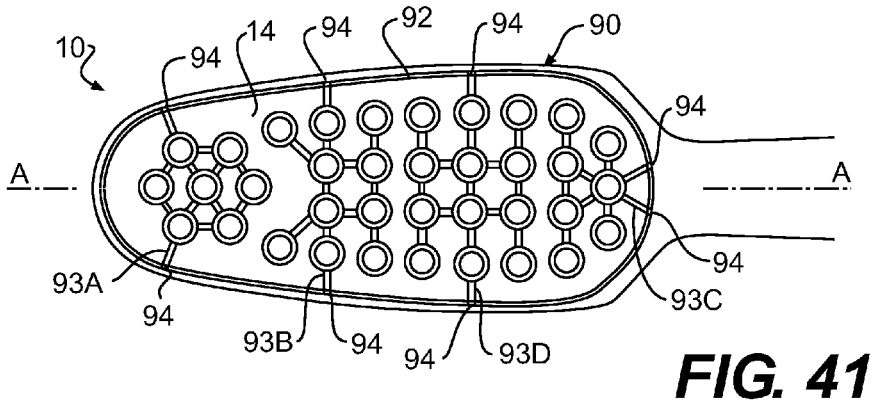

FIGS. 36-41 also show respective plan, side and underside views of a toothbrush head 10 of another embodiment of this invention, parts corresponding to FIGS. 1-35 being numbered correspondingly. There is a surrounding frame 90 similar in construction to FIGS. 33-35. The pad 14 is linked to the frame 90 by a continuous perimeter linking portion 92 of the pad 14 being of a reduced thickness. The bristle tufts 15 are held in small holders 16, as above, and the holders 16 are integrally connected to the frame 90 by being connected together by a web structure 93 which is integral with the holders 16. In FIG. 41 there are four separate web structures 93A-D.

In FIGS. 39-40 the pad 14 is flexibly connected to the frame by means of the oral hygiene parts 15 being connected to each other by the web structures 93 which are themselves connected to the frame 90 at points 94, and there is a gap 95 between the frame 90 and the pad 14.

Figure 42:
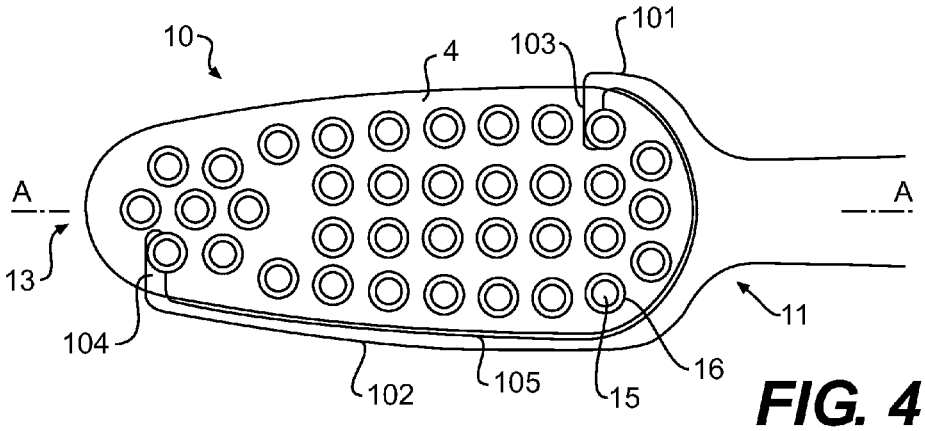
Figure 43:
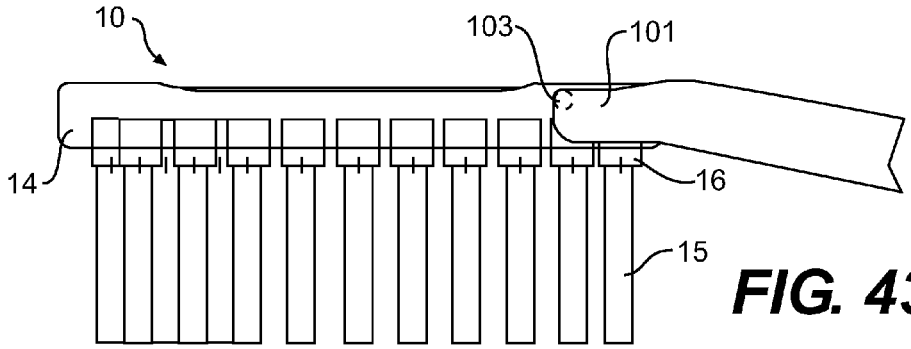
Figure 44:
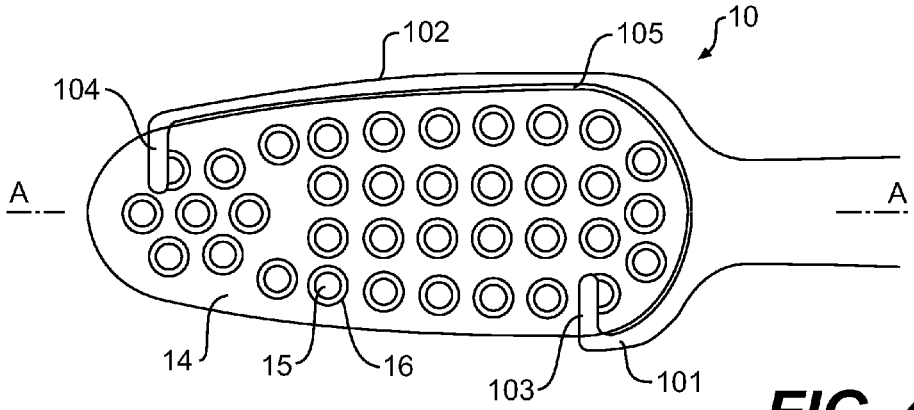

FIGS. 42-44 show respective plan, side and underside views of a toothbrush head 10 of another embodiment of this invention, parts corresponding to FIGS. 1-41 being numbered correspondingly. The support 100 comprises two plastics material arms 101,102 extending generally longitudinally on opposite sides of the longitudinal direction, connected by plural support parts 103,104 to the pad 14. The support parts 103,104 are the extremities of the arms 101,102. There is a gap 105 between the arms and the pad 14. The arms extend along part of the length of widthways opposite sides of the pad 14 and are of different lengths.

Figure 45:
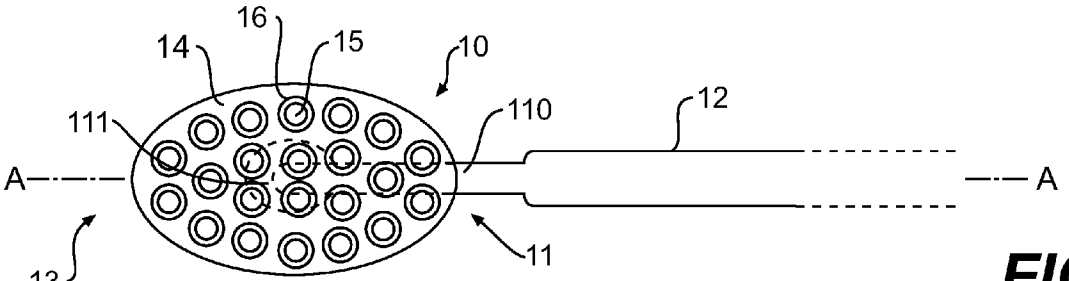
Figure 46:
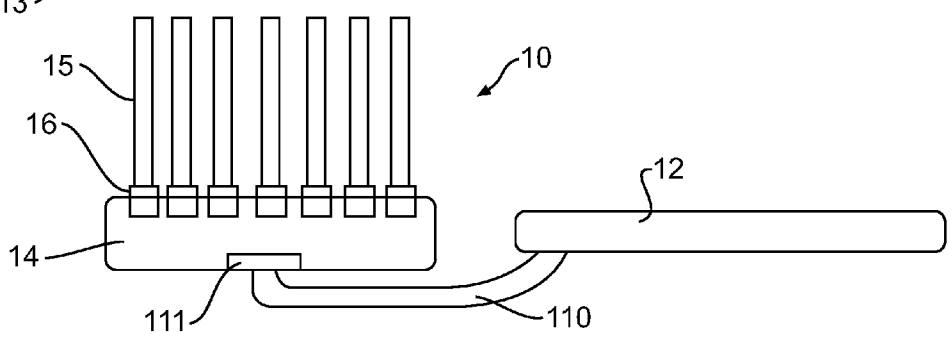
Figure 47:
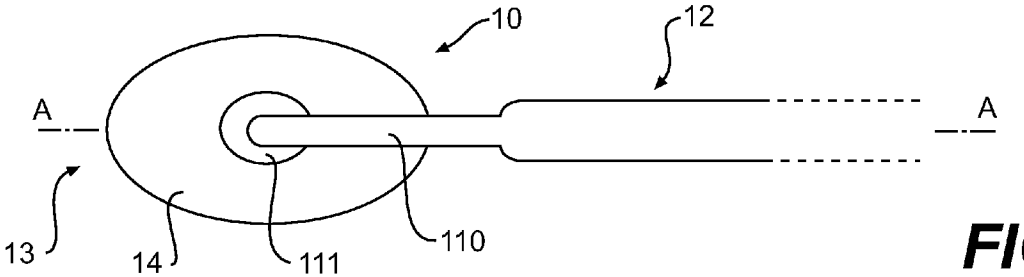

FIGS. 45-47 show respective plan, side and underside views of a toothbrush head 10 of another embodiment of this invention, parts corresponding to FIGS. 1-44 being numbered correspondingly. The plastic material support comprises an arm 110 extending generally longitudinally underneath the pad to a support part 111 intermediate between longitudinally opposite ends of the pad 14, approximately half way between longitudinally opposite ends of the pad. The support part 111 is in the form of an oval disc of plastic material integral with arm 110 and embedded in pad 14, the perimeter of the pad being otherwise unsupported.

Figure 48:
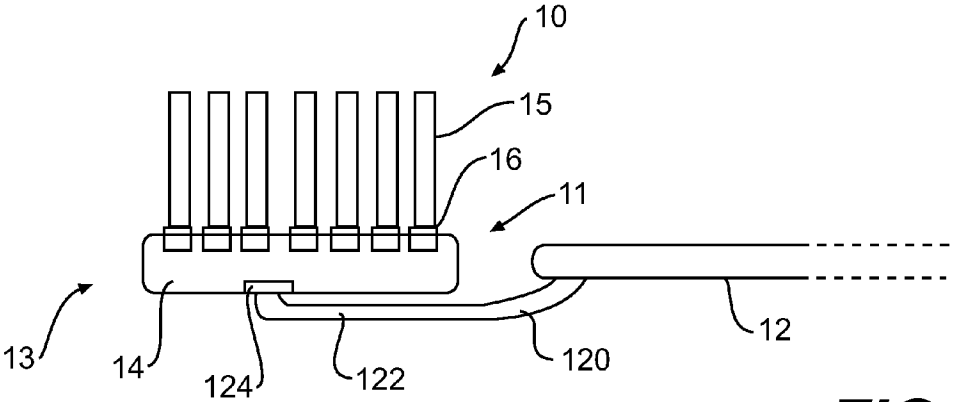
Figure 49:
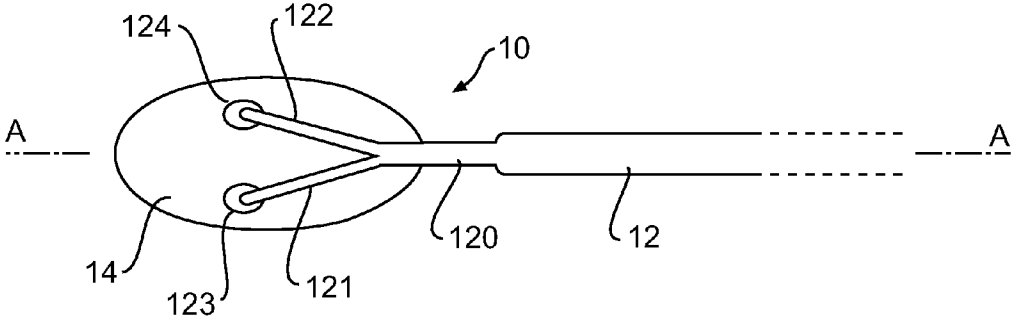

FIGS. 48 and 49 show respective side and underside views of a toothbrush head 10 of another embodiment of this invention, parts corresponding to FIGS. 1-47 being numbered correspondingly. The plastic material support comprises a neck part 120 between the grip handle 12 and the head 10, terminating integrally at its end closest to the head in a "Y" shape, with the two divergent limbs 121,122 of the "Y" being the arms, and the stem of the "Y" comprising the neck part 120. Each of the arms 121,122 terminates in a respective support part 123,124 of similar construction to that 111 of FIGS. 45-47.

Figure 50:
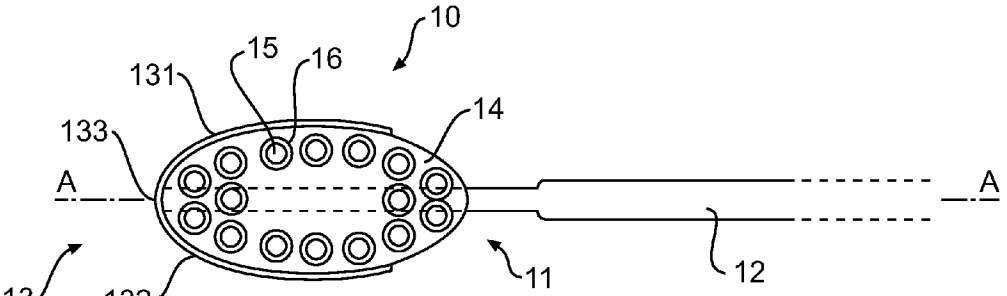
Figure 51:
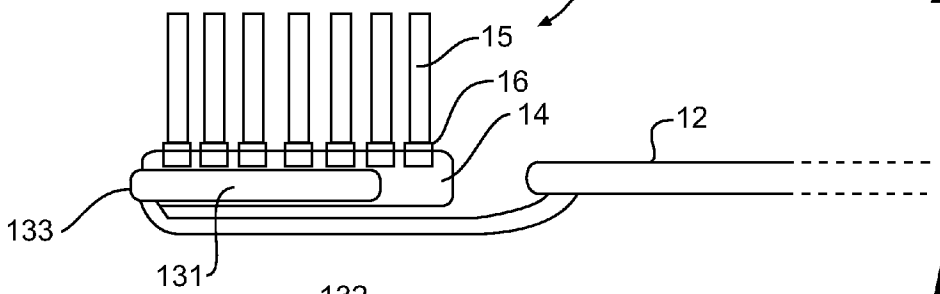

FIGS. 50-52 show respective plan, side and underside views of a toothbrush head 10 of another embodiment of this invention, parts corresponding to FIGS. 1-48 being numbered correspondingly. The plastic material support comprises two longitudinal arms 131,132 extending along both opposite sides of pad 14 and bonded to pad 14. The arms 131,132 are connected together at a connection point 133 furthest from the handle 12, and this connection point 133 is connected integrally to the handle 12 by means of longitudinal spine 134 extending underneath the pad 14.

The invention claimed is:

1. A toothbrush head having a first end connected to a toothbrush handle, and an opposite second end distant from the handle defining a longitudinal direction between the first and second ends and a widthways direction perpendicular to the longitudinal direction, the head comprising a thermoplastic elastomer material pad which is substantially planar in both the longitudinal and widthways directions and having a perimeter and in which are fixed oral hygiene parts, and comprising a plastic material support for the pad, wherein the support is in the form of two plastic material side arms extending longitudinally along widthways opposite sides of the pad parallel to and in the plane of the pad with either a gap between each side arm and the perimeter of the pad, or wherein the perimeter of the pad and the side arms are in sliding contact, and the pad being connected to the side arms by means of link arms integral with the side arms, two link arms being disposed sequentially longitudinally along each of the side arms adjacent the longitudinal ends of each side arm, and extending in a widthways direction relative to the longitudinal direction of the side arms and bridging between each side arm and the pad.

2. A toothbrush head according to claim 1 wherein the connection between each link arm and the pad provides a flexible connection.

3. A toothbrush head according to claim 1 wherein the side arms are provided by a neck part between the grip handle and the head, wherein the side arms diverge from the neck part in a "Y" shape.

4. A toothbrush head according to claim 1 wherein the pad and the side arms are in sliding contact.

5. A toothbrush head according to claim 1 wherein the pad is flexibly connected to the side arms by the link arms being attached to the arms at the perimeter of the pad, such that the elastic nature of the pad provides an inherent flexible connection.

6. A toothbrush head according to claim 1 wherein there is a gap between each side arm and the perimeter of the pad and the link arms bridge the gap between each side arm and the pad.

* * * * *